US008644720B2

(12) United States Patent
Schulze-Hagenest et al.

(10) Patent No.: US 8,644,720 B2
(45) Date of Patent: Feb. 4, 2014

(54) METHOD AND APPARATUS FOR FUSING A HEAT CURABLE TONER TO A CARRIER SHEET

(75) Inventors: Detlef Schulze-Hagenest, Molfsee (DE); Arun Chowdry, Pittsford, NY (US); Dinesh Tyagi, Fairport, NY (US); Domingo Rohde, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 355 days.

(21) Appl. No.: 12/808,437

(22) PCT Filed: Dec. 17, 2007

(86) PCT No.: PCT/EP2007/011056
§ 371 (c)(1),
(2), (4) Date: Sep. 1, 2010

(87) PCT Pub. No.: WO2009/076984
PCT Pub. Date: Jun. 25, 2009

(65) Prior Publication Data
US 2010/0329752 A1 Dec. 30, 2010

(51) Int. Cl.
*G03G 15/20* (2006.01)
*G03G 15/00* (2006.01)

(52) U.S. Cl.
USPC ..... 399/67; 399/322; 399/337; 399/341; 399/407

(58) Field of Classification Search
USPC ..... 399/67–69, 322, 337, 341, 407
See application file for complete search history.

(56) References Cited

U.S. PATENT DOCUMENTS

| | | | | |
|---|---|---|---|---|
| 2002/0090238 | A1* | 7/2002 | Bartscher et al. | 399/336 |
| 2002/0102118 | A1* | 8/2002 | Kosugi et al. | 399/341 |
| 2002/0141791 | A1 | 10/2002 | Rohde et al. | |
| 2003/0165766 | A1 | 9/2003 | Zhang et al. | |
| 2005/0207807 | A1 | 9/2005 | Tombs | |

FOREIGN PATENT DOCUMENTS

| | | |
|---|---|---|
| EP | 0848304 | 6/1998 |
| JP | 2005-049644 | 2/2005 |

* cited by examiner

*Primary Examiner* — Joseph S Wong
(74) *Attorney, Agent, or Firm* — Andrew J. Anderson; Raymond L. Owens

(57) ABSTRACT

A method and apparatus for fusing a heat curable toner to a carrier sheet having said toner thereon. In the method, the toner is sandwiched between said carrier sheet and a movable fuser belt and heated to a first temperature by a first means, which first temperature is above a first glass transformation temperature of the toner. The toner is kept at an elevated temperature for a predetermined time by a second means, which elevated temperature is above the first glass transformation temperature, thereby raising the glass transformation temperature of the toner to a second glass transformation temperature. The apparatus has at least a first endless fuser belt, first heating means for heating the toner to a first temperature, second heating means located downstream of said first heating means for keeping the toner at an elevated temperature for a predetermined time and control means for controlling the first and second heating means.

8 Claims, 2 Drawing Sheets

METHOD AND APPARATUS FOR FUSING A HEAT CURABLE TONER TO A CARRIER SHEET

BACKGROUND OF THE INVENTION

The present invention relates to a method and an apparatus for fusing a heat curable toner to a carrier sheet.

For printing different toners are known for forming an image or influencing the gloss of an image. One type of toner is a heat curable (cross-linkable) toner, which is typically fused to a carrier sheet by moving the carrier sheet and toner through a nip formed between two pressure rollers. Typically, one of the pressure rollers is heated above a glass transformation temperature of the toner, to melt the toner thereby intimately fusing the same to the carrier sheet. After passing the carrier sheet and toner through the nip between the pressure rollers, the toner is typically quickly cooled to a temperature below its glass transformation temperature.

During this fusing step, the thermally curable toner is only partially cured due to the short time it remains above the glass transformation temperature. Such a thermally curable toner, however, may be problematic in certain applications, in which a high thermal stability is required. Such an application is for example a printed car manual, which may be heated within a car to high temperatures above the glass transformation temperature of the toner. If this occurs, the pages of the car manuals could be fused together. Similar problems may arise, when printed media are X-rayed for sterilization to avoid anthrax attacks in US Government offices.

SUMMARY OF THE INVENTION

It is therefore an object of the present invention, to avoid one or more of the problems associated with heat curable toners.

In accordance with the present invention, a method for fusing a heat curable toner to a carrier sheet having the toner placed thereon, and which toner has a first glass transformation temperature is shown. The method comprises sandwiching the toner between said carrier sheet and a movable fuser belt, heating the toner to a first temperature by a first means, which first temperature is above the first glass transformation temperature, and keeping the toner at an elevated temperature for a predetermined time by a second means, which elevated temperature is above the first glass transformation temperature, thereby raising the glass transformation temperature of the toner to a second glass transformation temperature, said second glass transformation temperature being higher than the first glass transformation temperature and below the elevated temperature. If a heat curable toner is kept for a prolonged period above its glass transformation temperature, cross-linking of its polymer chains occurs. This cross-linking of the polymer chains leads to a shift of the glass transformation temperature to a higher value. Parallel, the viscosity of the toner increases, both of which lead to a higher temperature stability of the toner image. At the same time, the gloss characteristic of the toner surface is adjusted by the surface characteristic of the fuser belt.

Further, an apparatus for fusing a heat curable toner to a carrier sheet having said toner placed thereon is disclosed. The apparatus comprises at least a first fuser belt which is entrained about a first set of at least two rotatable rollers, a drive mechanism for rotating the first fuser belt about said rotatable rollers, first heating means for heating the toner to a first temperature, second heating means located downstream of said first heating means for keeping the toner at an elevated temperature for a predetermined time, and control means for controlling the first and second heating means such that they heat and keep, respectively, the toner at a temperature above its glass transformation temperature for a predetermined time.

The foregoing and other objects, features and advantages of the present embodiments will be apparent from the following more detailed description of exemplary embodiments of the apparatus and the method, as illustrated in the accompanying drawings.

DESCRIPTION OF PREFERRED EMBODIMENTS

The following description uses relative terms such as left right above and below, which relative terms refer to the drawings and should not be construed to limit the application.

Figure 1:
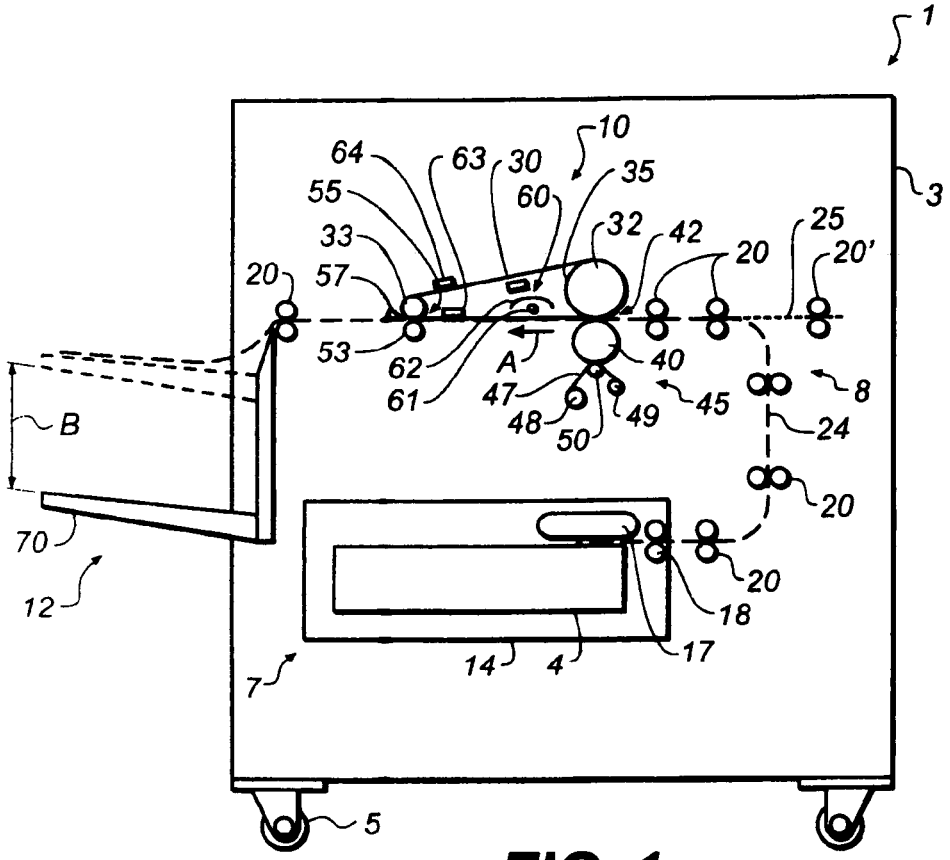
FIG. 1 is an exemplary side elevational view of a fuser apparatus.

FIG. 1 illustrates a side elevational view of a fuser apparatus 1. The fuser apparatus 1 as shown has a housing 3 supported by a plurality of wheels 5 (two of which are shown), to allow flexible placing of the fuser apparatus 1. Even though housing 3 is shown on wheels 5, it should be noted that the fuser apparatus 1 could be of the stationary type without wheels 5.

Housing 3 supports a sheet supply 7, a transport arrangement 8, a fuser arrangement 10 and a sheet delivery 12. The sheet supply 7 can be any conventional sheet supply for supplying carrier sheets having toner thereon. In particular, the sheet supply 7 comprises a housing 14, in which a cassette 4 holding a stack of sheets is arranged. In said housing a feed mechanism consisting of a sheet pick-up device 17 and a pair of feed rollers 18 is provided.

The transport arrangement consists of a plurality of pairs of feed rollers 20, and guide elements (not shown), for forming a sheet transport path 24 as shown by a dashed line. The sheet transport path 24 extends from the sheet supply 7 to the fuser arrangement 10, through the fuser arrangement 10 and from the fuser arrangement 10 to the sheet delivery 12. Additionally, the transport arrangement may comprise at least one pair of feed rollers 20', which is (are) arranged to feed sheets from an external source into the sheet transport path 24, as shown by the dotted line 25. The transport arrangement 8 can thus feed sheets from the sheet supply 7 or from an external source to the fuser arrangement 10.

If the fuser apparatus 1 is used as a stationary fuser apparatus in an in-line-application, such as for example in line with a printer, which would be an external source of sheets, the sheet supply 7 and part of the transport arrangement 8 may be dispensed with as would be obvious for a skilled artisan.

The fuser arrangement 10 is of the belt fuser type. The fuser arrangement 10 has a belt 30, which is a closed loop belt. The belt 30 is entrained under tension around a roller 32 at an inlet side of the fuser arrangement 10 and a roller 33 at the outlet end of the fuser arrangement 10. The outside surface of the belt is very smooth, as the smoothness of the surface determines the gloss of the toner, as will be described in more detail herein below. The surface of the fuser belt is such that it preferably imparts a gloss to the toner on the carrier sheet having a G20 gloss value of approximately ≥70.

Both rollers 32, 33 are rotatable about a respective axis of rotation. One of the rollers 32, 33 is coupled to a drive mechanism for rotating the respective roller to thereby rotatably drive the belt 30 in the direction of arrow A around the rollers 32, 33.

In the embodiment shown in FIG. 1 the roller 32 is a heated roller, including a hollow cylindrical element made from metal, such as aluminum, having a polished surface 35. In the hollow interior of the cylindrical element, a first heating mechanism (not shown), such as a variable power lamp is provided. Alternatively, roller 32 could also by heated by an external heating mechanism, for example via contact with an externally located heated roller, or also by a variable power lamp. During operation of the fuser arrangement 10, the roller 32 is typically heated to a temperature between 130° C. and 170° C., and preferably between 140° C. and 160° C.

Below roller 32 a pressure roller 40 is provided. The pressure roller 40 is rotatable around an axis of rotation, which axis of rotation is horizontally aligned with the axis of rotation of the roller 32. Pressure roller 40 is arranged to press against the roller 32 with a predetermined force, forming a pressure nip 42 through which the fuser belt 30 and a carrier sheet having toner thereon may move under pressure. The pressure roller 40, includes a cylindrical element, for example made from aluminum. A resilient layer, for example made of RTV thermoplastic is provided around said cylindrical element. In a preferred embodiment, the resilient layer is made of Silastic J (Silastic J is a trademark for RTV silicon rubber available from Dow Corning Corp., Midland, Mich.), having a thickness in the range of approx. between 3 mm to 10 mm, and preferably of about 5 mm. In the embodiment as shown, pressure roller 40 is not heated by a separate heating mechanism, however, a separate heating mechanism for heating roller 40 may also be provided.

As mentioned above, the pressure roller 40 is pressed against the roller 32 with a predetermined force. This predetermined force deforms the resilient layer in the pressure nip 42, thereby determining the pressure applied in the pressure nip and the nip width. A control mechanism may be provided for adjusting the pressure in order to optimize the pressure and the nip width for different carrier sheets, in particular, carrier sheets having different thicknesses. Typically, the force applied between the rollers 32 and 40 is in a range of approx. between 50 pounds/linear inch and 150 pounds/linear inch, preferably about 100 pounds/linear inch. The resulting nip width is typically in a range of approximately 10 mm to 25 mm and preferably about 18 mm.

Carrier sheets having a range of weights may be moved through nip 42. In particular, carrier sheet may typically have a weight in the range of approximately between 180 g/m$^2$ to 300 g/m$^2$.

As shown in FIG. 1, a cleaning mechanism 45 is provided for pressure roller 42. The cleaning mechanism as shown includes a cleaning web 47 extending from a supply spool 48 to a take-up spool 49 via a contact roller 50. The contact roller 50 presses the cleaning web 47 against the pressure roller 40, to clean the same. Any suitable cleaning mechanism can be employed in lieu of the specific cleaning mechanism 45, which ensures proper cleaning of the pressure roller 40.

A roller 53 is provided below roller 33, for forming a transport nip 55 there-between. Roller 33 has a substantially smaller diameter than the diameter of roller 32. A typical diameter of roller 33 is in the range of 2.5 cm to 4 cm. The small diameter of roller 33 facilitates release of the carrier sheet and toner from the fuser belt, after fusing the toner to the carrier sheet, as will be explained in more detail herein below. Roller 33 may be gimbaled, in order to assure proper tracking of fuser belt 30 as it moves along the close loop path.

At the outlet end of the transport nip 55, a squeegee 57 is provided in order to assist separation of the carrier sheet and toner from the fuser belt 30.

The fuser arrangement 10 also comprises a second heating mechanism 60, such as a variable power lamp, which is arranged in the space between rollers 32 and 33 surrounded by the fuser belt 30. The second heating mechanism 60 is arranged to heat a portion of the fuser belt extending along the sheet transport path 24. In the embodiment shown in FIG. 1, the heating mechanism 60 comprises an IR-lamp 61 and a reflector 62, reflecting IR-radiation towards the fuser belt 30. Alternatively, the heating mechanism could also be of a resistance heater type, which may be arranged adjacent to the fuser belt or which may even be integrated therein. Also other types of heating arrangements such as inductive heaters may be used.

The fuser arrangement 10 also comprises a cooling arrangement 63, such as an air blower, which is arranged in the space between rollers 32 and 33 surrounded by the fuser belt 30. The cooling arrangement 63 is arranged downstream of the heating mechanism 60 along the sheet transport path 24, and may for example blow air (not pre-cooled) in a range of approximately between 1100 l per minute and 1400 l per minute towards the fuser belt 30. However, any suitable flow rate and also pre-cooled air may be used.

A cleaning station 64 is provided for cleaning an outside surface of the fuser belt 30 during operation thereof. The cleaning station 64 is arranged above the fuser belt in order to avoid interference with a carrier sheet and toner during fusing thereof. Any suitable cleaning mechanism can be employed in the cleaning station 64. The cleaning mechanism 64 should ensure the smoothness of the outside surface of the fuser belt 30, which smoothness is a primary determinant of gloss imparted to the toner carried by a carrier sheet. Thus the cleaning mechanism should be capable of freeing the outside surface of the fuser belt of any substance, which can affect this smoothness, such as for example, particulate contamination including toner particles, dust, and fibers. In some instances, the cleaning station 64 may be dispensed with where contaminations on the outside surface of fuser belt are securely transferred to the surface of pressure roller 40 and are then removed therefrom by cleaning mechanism 45. It is preferred that the fusing apparatus 1 does not require the outside surface of belt to be treated with a release compound, such as for example a polydiorganosiloxane release oil, or zinc stearate, or other low surface energy compound. In fusing apparatus 1, separation of the toner from the fuser belt at the outlet end of the fusing arrangement preferably occurs without the use of replenishable release material on belt. Use of such a material would require an additional station for application of the material to the surface of the fuser belt 30, e.g., an oiling station.

The sheet delivery 12 comprises a support tray 70, which is adjustable in heights, as indicated by the double-headed arrow B. The dotted line shows the support tray 70 in an elevated position for receiving carrier sheets at the end of the sheet transport path 24. The solid line shows the support tray 70 in a lowered position.

The apparatus comprises an appropriate controller (not shown) for controlling operation of the individual components such as the transport mechanism, the drive for the fuser belt, the heating mechanisms etc.

Operation of the fuser apparatus 1 shown in FIG. 1 will now be described herein below with reference to specific Examples and FIGS. 3 and 4.

It is assumed that the sheet supply is filled with carrier sheets having toner on one side thereon, which toner is sufficiently fixed to the carrier sheet not to be influenced by the transport mechanism. The toner is a heat curable toner having a first glass transformation temperature TG1 preferably in a range from 45° C. to 75° C. prior to the fusing process described below. The toner may be a powdery dry toner having polymer chains, which form cross-links when heated above the glass transformation temperature thereof.

One specific example of a toner, which was used in fusing experiments included the following components:

1. Uralac P 3250 (saturated, carboxylated polyester resin) with 56% portion of total weight of the toner,
2. D.E.R.662E (cross-linking agent) with 44% portion of total weight of the toner, and
3. Color pigment with 4% portion of total weight of the toner (not used for clear toner).

Optionally, additives to control the melt flow, the surface quality, the toner charge, the powder flow, and if necessary, additional additives may be added as required.

The raw materials of this toner were mixed together and molten-mixed in a heated two-roller mill. The temperature of the roller and the mixture was kept below 100° C. so that no significant cross-linking takes place in this production step. The cooled-off extrudate is milled to a particle size of 3 mm and then brought into a fluid-energy mill, which pulverizes it further. Finally, the fine toner particles are classified to an average particle size of approx. 8 μm.

The above is only one example of a heat curable toner having polymer chains forming cross-links when heated above its glass transformation temperature, and other toners having different components may be used in combination with the apparatus and method described herein.

One of the carrier sheets is picked up from the sheet supply 7 and moved along the sheet transport path 24 towards fuser arrangement 10. The carrier sheet is transported such that the toner faces roller 32 and fuser belt 30, when entering the pressure nip 42. The fuser belt is driven with a speed of about 15 cm/s or faster around the rollers 32 and 33. Alternative, the carrier sheet may also be provided by an external source such as an electrophotographic printing machine via transport roller 20'.

The roller 32 is heated to a temperature between 130° C. and 170° C., and preferably between 140° C. and 160° C. Due to the roller being heated well above the first glass transformation temperature $T_{G1}$ of the toner, the temperature of the toner is quickly raised above its glass transformation temperature.

Figure 3:
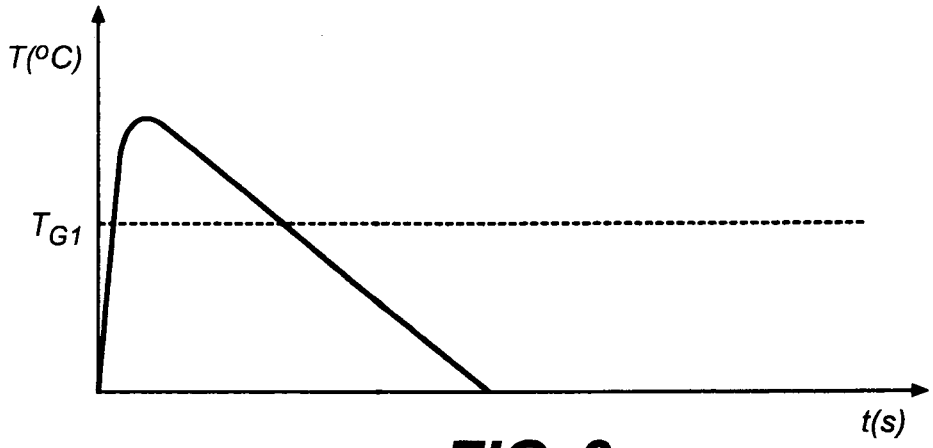
FIG. 3 is a temperature-time-diagram of a conventional method for fusing a heat curable toner to a carrier sheet.
Figure 4:
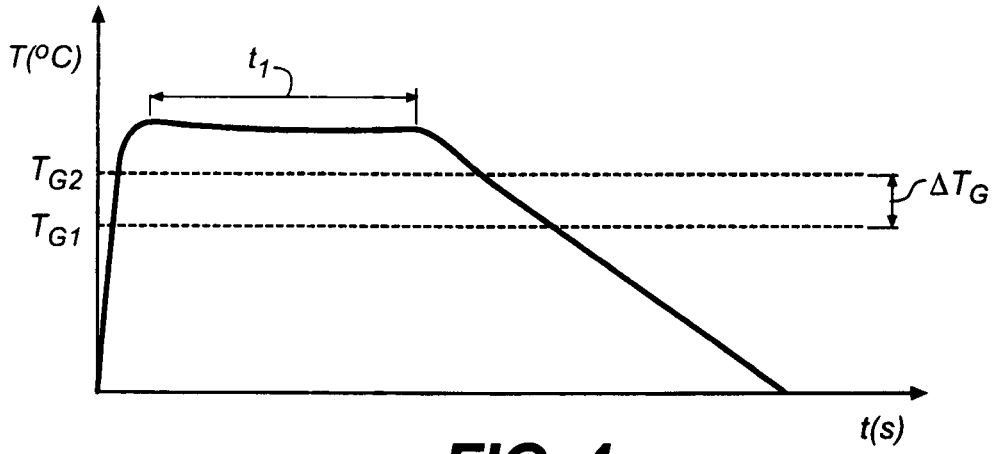
FIG. 4 is a temperature-time-diagram of a method for fusing a heat curable toner to a carrier sheet in accordance with an exemplary embodiment.

This is for example shown in the temperature-time-diagrams of FIGS. 3 and 4, which each show the temperature of the toner along a straight line perpendicular to the direction of transport, while the carrier sheet is moved through the fuser arrangement 10. FIG. 3 shows a temperature-time-diagram of a case, where the heating mechanism 60 is not activated, which would correspond to conventional fusing in a belt fuser. FIG. 4 shows a similar temperature-time-diagram, however, this time with the heating mechanism 60 being activated.

As shown in both FIGS. 3 and 4, the temperature of the toner is quickly raised above its first glass transformation temperature $T_{G1}$. The toner melts and is intimately fused to the carrier sheet.

After the carrier sheet and toner pass through the nip 40, the toner will quickly cool below the glass transformation temperature, if the heating mechanism 60 is not activated, as shown in FIG. 3. Keeping the tone only for a short period of time typically well below one second, leads only to a limited amount of cross-linking of the polymer chains of the toner.

If, however, the heating mechanism 60 is activated, the temperature of the toner may be kept above the glass transformation temperature $T_{G1}$ for a prolonged period of time as shown in FIG. 4. In FIG. 4 the time span t1 represents the time, in which the toner is heated by the heating mechanism 60. The time $t_1$ is preferably in the range of about 1 second to about 10 seconds. Due to this prolonged heating above the glass transformation temperature $T_{G1}$, a substantial amount of cross-linking can occur between the polymer chains of the toner, making the resulting toner layer more stable. During the time $t_1$, the temperature of the toner was kept approximately constant at about the temperature of the roller 32. The temperature of the toner, however, may also be kept at a temperature above or below the temperature of roller 32 during the time $t_1$ as long as the temperature is above the glass transformation temperature of the toner to allow the cross-linking to proceed. It is also not necessary to keep the temperature substantially constant during the time period $t_1$. The amount of heat provided by the heating mechanisms is controlled by a controller to keep the toner temperature at the desired level.

The cross-linking of the polymer chains, caused the glass transformation temperature of the toner to be raised by 5-10° C. to a second glass transformation temperature $T_{G2}$ as indicated in FIG. 4. The cross linking also caused an increase of the viscosity of the toner. It is preferred to achieve an increase in the glass transformation temperature of at least 5° C.

The thus cured toner images on the substrates showed significant improved mechanical and thermal stability and solvent resistance. Paper substrates with partial thermal curing are still deinkable in the papermaking process for recycling paper. This process can thus be used for printed-paper that will be collected for paper recycling.

In an alternative example curing was performed in the same way as described above except that the fixing and curing temperature was approximately at 220° C. In this experiment the toner was fully cured resulting in a glass temperature increase of more than 10° C. The fully cured images on the substrates showed higher mechanical and thermal stability and solvent resistance but were no more deinkable in the papermaking process for recycling paper and cannot be used for printed-paper that will be collected for paper recycling.

After the carrier sheet and toner pass the heating mechanism 60, the combination may be actively cooled by cooling mechanism 63 to fall close to, or below the raised glass transformation temperature $T_{G2}$. Depending on the amount of cross-linking, cooling below the glass transformation temperature is not always necessary, as the toner is transferred into a more elastic structure, which can achieve—dependent of the level of curing—a rubber like structure which would also separate from the fuser belt at temperature above the glass transformation temperature without causing artefacts. At the outlet end of the fuser arrangement 10 the combination of carrier sheet and toner is removed from the fuser belt 30, which removal is assisted by squeegee 57.

The thus fused carrier sheet and toner are then transported to sheet delivery 12.

Figure 2:
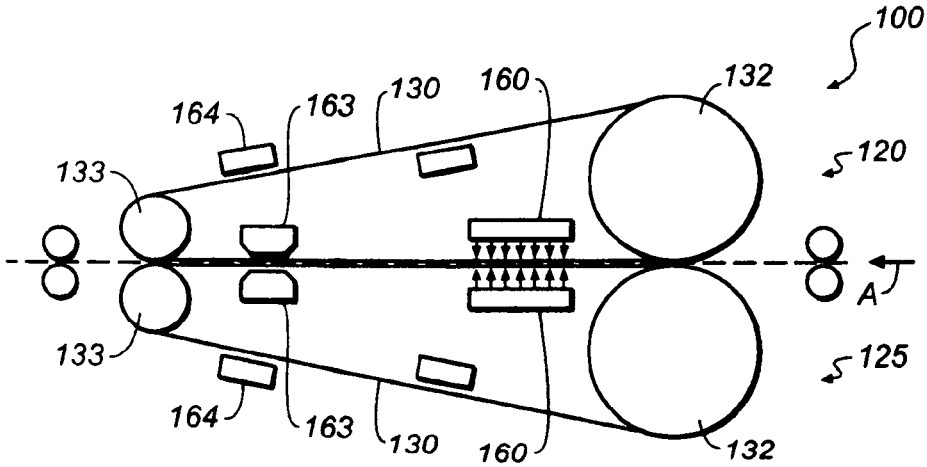
FIG. 2 is a side elevational view of an alternative fuser arrangement.

FIG. 2 shows an alternative fuser arrangement 100, which may for example be used in the fuser apparatus as shown in FIG. 1. The fuser arrangement 100 is again of the belt fuser type. The fuser arrangement 100 has a first fuser assembly 120 comprising a closed loop belt 130, which may be of the same type as the belt 30 described with respect to FIG. 1. The belt 130 is entrained under tension around a roller 132 at an inlet side of the fuser arrangement 100 and a roller 133 at the outlet end of the fuser arrangement 100. Both rollers 132, 133 are rotatable about a respective axis of rotation, and one of the rollers 132, 133 preferably roller 132 is coupled to a drive mechanism for rotating the respective roller to thereby rotatably drive the belt 130 in the direction of arrow A around the rollers 132, 133.

Roller 132 may be of the same type as roller 32 described above, and a first heating mechanism (not shown), such as a variable power lamp is provided for heating the roller 132. Roller 133 is again of the same type as roller 33 described above.

The first fuser assembly 120 also comprises a second heating mechanism 160, such as a variable power lamp, which is arranged in the space between rollers 132 and 133 surrounded by the fuser belt 30. The second heating mechanism 160 is arranged to heat a portion of the fuser belt extending along the sheet transport path 24. Furthermore, the first fuser assembly 120 comprises a cooling arrangement 163, such as an air blower, which is arranged in the space between rollers 132 and 133 surrounded by the fuser belt 130. The cooling arrangement 163 is arranged downstream of the heating mechanism 160 along the direction of movement A of the fuser belt 130. The heating and cooling mechanisms 160, 163 may be of the same type as described above with reference to FIG. 1.

A cleaning station 164 is provided as part of the first fusing assembly 120 for cleaning an outside surface of the fuser belt 130 during operation thereof. The cleaning station 164 is arranged above the fuser belt in order to avoid interference with a carrier sheet and toner during fusing thereof. Any suitable cleaning mechanism can be employed in the cleaning station 164 and it may be of the same type as the cleaning station 64 described above with reference to FIG. 1.

The fusing arrangement 100 also comprises a second fusing assembly 125 having in substance the same components (indicated by the same reference signs) as the first fusing assembly 120. The main difference being that the fusing assembly 125 is arranged in an inverted manner below the first fusing assembly, to form a fusing nip between the respective fusing belts 130. The respective rollers 132 at the inlet end of the fuser arrangement are pressed against each other to form a pressure nip therebetween. The roller 132 of the lower (or the upper) fuser assembly 120, 125 may have a resilient layer, for example made of RTV thermoplastic on the outside thereof, similar to pressure roller 40 described with respect to FIG. 1. In the fuser arrangement 100 one or both of the rollers may be heated, even though heating of both is preferred. On or both of the rollers 132 are coupled to a drive, preferably both are coupled to a common drive for synchronous rotation thereof. Rollers 133 at the outlet end of fuser arrangement 100 are arranged to form a transport nip therebetween, and even though not shown, respective squeegees may be provided adjacent the one or each of the rollers 133.

Operation of the fuser arrangement 100 is substantially the same as the operation described thereof. Due to the two belt fusing assembly 120, 125, however, carrier sheets having toner on opposed surfaces thereof may be glossed and (partially) cured on both sides, while being fused.

INDUSTRIAL APPLICABILITY

The apparatuses shown above may be used for fusing a heat curable toner to a carrier sheet having the toner placed thereon, to produce (partially) cured prints. Both simplex and duplex prints may be handled, while glossing at least one of the surfaces of the prints, as the gloss of the fuser belt 30, 130 is transferred to the surface of the toner. The apparatuses especially allow improved curing of heat curable toner to achieve a higher glass transformation temperature of the toner, thus leading to higher temperature stability of the print.

The apparatuses can be housed in a stand-alone or "off-line" accessory unit as shown in FIG. 1. The fusing arrangements, however, can also be housed inside an electrophotographic printing machine for "in-line" or "parallel-line" usage therein. Alternatively they can be located within adjunct equipment attached to an electrophotographic reproduction apparatus. Furthermore, they can be employed "near-line", i.e., set points for processing zones can be electronically controlled or adjusted by means of information sent to arrangements, e.g., from an associated electrophotographic reproduction apparatus. Such information can for example be used for adjusting the temperature and/or pressure in the pressure nip, the heat exposure from the second heating mechanism, and the flow rate and/or temperature of the flow of air through the cooling mechanism. Such adjustments of set points can be carried out for example when different types of receiver members having varying weights and/or thicknesses are sent to the fuser arrangement for partial thermal glossing, or when different types and/or coverages of color toners are used in pre-gloss toner images.

The invention has been described with respect to specific embodiments thereof without the intention to thereby limit the scope of the invention, which is defined by the appended claims.

The invention claimed is:

1. A method for fusing a heat curable toner to a carrier sheet having the toner placed thereon and controlling its gloss characteristic, said heat curable toner having a first glass transformation temperature, said method comprising:

sandwiching the heat curable toner between said carrier sheet and a movable fuser belt provided with a surface characteristic representing a desired gloss;

heating the heat curable toner to a first temperature by a first means, which first temperature is above the first glass transformation temperature; and keeping the heat curable toner at an elevated temperature for a time period between approximately 1 second and approximately 10 seconds by a second means, which elevated temperature is above the first glass transformation temperature, thereby crosslinking polymer chains of the heat curable toner and raising the glass transformation temperature of the heat curable toner to a second glass transformation temperature, said second glass transformation temperature being higher than the first glass transformation temperature and below the elevated temperature so that the cured toner image has a gloss characteristic caused by the surface characteristic of the surface of the movable fusing belt.

2. The method of claim 1, wherein heating by said first means is achieved by moving the fuser belt, carrier sheet and heat curable toner through a nip between two rollers, at least one of which is heated to a temperature above said first glass transformation temperature.

3. The method of claim 2, wherein the heat curable toner stays sandwiched between the carrier sheet and the fuser belt at least during a part of the time at which the heat curable toner is kept at said elevated temperature.

4. The method of claim 3, wherein said fuser belt is heated to keep the heat curable toner at the elevated temperature.

5. The method of claim 4, wherein said fuser belt is heated by at least one radiation source.

6. The method of claim 4, wherein said fuser belt is heated by at least one resistance heater, adjacent to or integrated into said fuser belt.

7. The method of claim 4, wherein said heat curable toner is cooled below said second glass transformation temperature before separating the same from the fuser belt.

8. The method of claim 1, wherein said second glass transformation temperature is at least 5° C. higher than said first glass transformation temperature.

* * * * *